US005510750A

United States Patent [19]

Cho

[11] Patent Number: 5,510,750

[45] Date of Patent: Apr. 23, 1996

[54] BIAS CIRCUIT FOR PROVIDING A STABLE OUTPUT CURRENT

[75] Inventor: Shizuo Cho, Miyazaki, Japan

[73] Assignee: Oki Electric Industry Co., Ltd., Tokyo, Japan

[21] Appl. No.: 189,545

[22] Filed: Feb. 1, 1994

[30] Foreign Application Priority Data

Feb. 1, 1993 [JP] Japan ..... 5-014780

[51] Int. Cl.[6] ..... G05F 3/02

[52] U.S. Cl. ..... 327/546; 327/538; 327/108; 323/315

[58] Field of Search ..... 327/543, 530, 327/538, 546, 545, 540, 541, 108; 323/312, 315

[56] References Cited

U.S. PATENT DOCUMENTS

| | | | |
|---|---|---|---|
| 4,327,321 | 4/1982 | Suzuki et al. | 323/315 |
| 4,450,367 | 5/1984 | Whatley | 323/538 |
| 5,038,053 | 8/1991 | Djenguerian et al. | 323/315 |
| 5,109,187 | 4/1992 | Guliani | 323/315 |
| 5,173,656 | 12/1972 | Seevinck et al. | 323/315 |
| 5,243,231 | 9/1993 | Baik | 327/546 |

FOREIGN PATENT DOCUMENTS 2-268010 11/1990 Japan .

*Primary Examiner*—Timothy P. Callahan
*Assistant Examiner*—Terry L. Englund
*Attorney, Agent, or Firm*—Spencer & Frank

[57] ABSTRACT

A bias circuit supplies a predetermined current to a next-stage circuit. The bias circuit comprises a first node having a first potential, a second node having a second potential, an output node electrically connected to the next-stage circuit, a main bias circuit electrically connected to the first node and the output node and for supplying the predetermined current from the first node to the output node, and an auxiliary bias circuit electrically connected to the first and second nodes and the output node and for equalizing the value of a current flowing from the first node to the output node to the value of a current flowing from the output node to the second node.

7 Claims, 1 Drawing Sheet

BIAS CIRCUIT FOR PROVIDING A STABLE OUTPUT CURRENT

BACKGROUND OF THE INVENTION

1. Field of the Invention

This invention relates to a bias; circuit suitable for use in a semiconductor integrated circuit or the like, for biasing the semiconductor integrated circuit.

2. Description of the Related Art

A conventional bias circuit, is disclosed in Japanese Patent Application Laid-Open Publication No. 2-268010.

This type of bias circuit is provided between a power source potential line and a ground potential line and is composed of a current mirror circuit, etc. The operation of a next-stage circuit having switching means such as a MOS transistor, etc., is controlled based on the output current of the bias circuit.

A semiconductor integrated circuit makes it necessary to reliably operate even when a power source potential changes abruptly. Further, the bias circuit also needs to stably supply a predetermined potential to the next-stage circuit.

SUMMARY OF THE INVENTION

It is an object of the present invention to provide a bias circuit for stably supplying a predetermined potential to provide a reliable operation even if a power source potential abruptly changes.

According to one aspect of the present invention, for achieving the above object, there is provided a bias circuit for supplying a predetermined current to a next-stage circuit, comprising a first node having a first potential, a second node having a second potential, an output node electrically connected to the next-stage circuit, a main bias circuit electrically connected to the first node and the output node and for supplying the predetermined current from the first node to the output node, and an auxiliary bias circuit electrically connected to the first and second nodes and the output node and for equalizing the value of a current flowing from the first node to the output node to the value of a current flowing from the output node to the second node.

DETAILED DESCRIPTION OF THE PREFERRED EMBODIMENT

Figure 1:
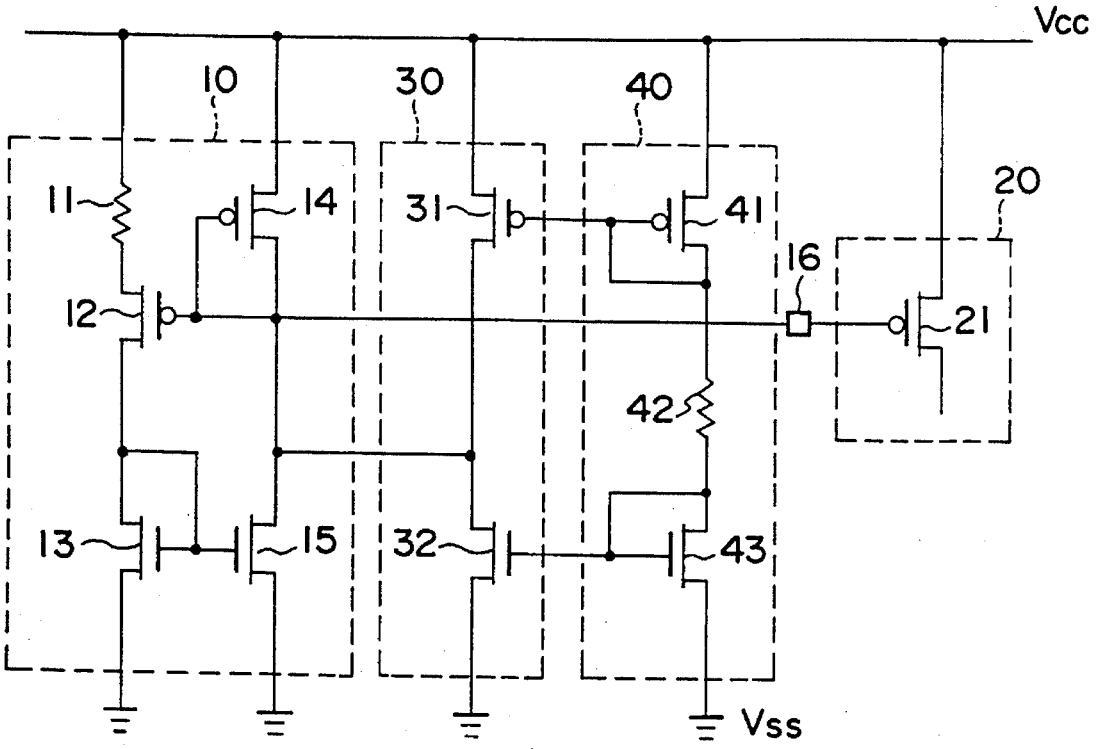
FIG. 1 is a circuit diagram showing a bias circuit.

A bias circuit according to the present invention is shown in FIG. 1.

The bias circuit shown in FIG. 1 basically comprises a current-mirror type bias circuit 10 which serves as a main bias circuit, a current bypass circuit 30 which serves as an auxiliary bias circuit and a bias circuit 40 for supplying a predetermined potential to the current bypass circuit 30. The current-mirror type bypass circuit 10, the current bypass circuit 30 and the bias circuit 40 are electrically connected between a first power source (e.g., a power source potential Vcc) and a second power source (e.g., a ground potential Vss).

The current-mirror type bias circuit 10 has a resistor 11, a P channel MOS transistor 12 (hereinafter called a "PMOS") and an N channel MOS transistor 13 (hereinafter called an "NMOS") all of which are series-connected between the power source potential Vcc and the ground potential Vss. Further, the current-mirror type bias circuit 10 also includes a PMOS 14 and an NMOS 15 series-connected between the Dower source potential Vcc and the ground potential Vss. The gate of the PMOS 12 is electrically connected to the gate and drain of the PMOS 14, an output terminal 16 serving as an output node and the drain of the NMOS 15. In addition, the drain and gate of the NMOS 13 are electrically common-connected to the gate of the NMOS 15.

A next-stage circuit 20 is electrically connected to the output terminal 16. The next-stage circuit 20 has a PMOS 21 which serves as a constant-current source. The PMOS 21 whose source and gate are electrically connected to the power source potential Vcc and the output terminal 16, respectively, serves as a transistor for supplying a constant current flowing in the drain thereof to other components.

In the current-mirror type bias current 10, the PMOSs 12 and 14 and the NMOSs 13 and 15 are activated at weak inversion regions. If a voltage drop developed across the resistor 11 is represented as V11, it is then expressed by the following equation (1):

$$V11=kT/q\cdot In\cdot(W12/W14\cdot W15/W13) \quad (1)$$

where k: Boltzmann's constant

T: absolute temperature q: unit charge quantity

W12: width of gate of PMOS 12

W13: width of gate of NMOS 13

W14: width of gate of PMOS 14

W15: width of gate of NMOS 15

Thus, a current i which flows in the PMOS 12 is given by the following equation (2):

$$i=V11/R11\cdot W15/W13 \quad (2)$$

where R11: resistance value of resistor 11

As expressed in the equation (2), the current-mirror type bias circuit 10 is operated as a constant-current source free of dependence upon the power source potential Vcc.

The current bypass circuit 30 has a PMOS 31 and an NMOS 32 series-connected between the power source potential Vcc and the ground potential Vss. The drain of the PMOS 31 and the drain of the NMOS 32 are electrically connected to the output terminal 16 of the current-mirror type bias circuit 10.

The bias circuit 40 has a PMOS 41, a resistor 42 and an NMOS 43 series-connected between the power source potential Vcc and the ground potential Vss. The gate and drain of the PMOS 41 are electrically common-connected to the gate of the NMOS 31. Further, the gate and drain of the NMOS 43 are electrically common-connected to the gate of the NMOS 32.

Operations of the current bypass circuit 30 and the bias circuit 40 will next be described below.

If a voltage drop across the PMOS 41, a resistance value of the resistor 42 and a voltage drop across the NMOS 43 are represented as V41, R42 and V43, respectively, then a current $i_B$ which flows in the bias circuit 40, is given by the following equation (3):

$$i_B=(Vcc-V41-V43)/R42 \quad (3)$$

Since the gate of the PMOS 31 and the gate of the NMOS 32 are electrically connected to the gate of the PMOS 41 and the gate of the NMOS 43, respectively, and a voltage applied between the gate of the PMOS 31 and the source of the PMOS 41 is equal to that applied between the gate of the NMOS 32 and the source of the NMOS 43, the PMOS 31 and the NMOS 32 serve as current sources, respectively. If currents which flow in the PMOS 31 and the NMOS 32 are represented as i31 and i32, then they are given by the following equations (4) and (5):

$$i31=W31/W41\cdot i_B \quad (4)$$

$$i32=W32/W43\cdot i_B \quad (5)$$

where

W31: width of gate of PMOS 31

W32: width of gate of NMOS 32

W41: width of gate of PMOS 41

W43: width of gate of NMOS 43

If W31/W41=W32/W43, then i31=i32. Thus, although the drains of the PMOS 31 and the NMOS 32 are electrically connected to the output terminal 16 of the current-mirror type bias circuit 10, the drains thereof and the output terminal 16 do not substantially electrically interfere with each other.

Therefore, each of the PMOSs 12 and 14 will take a nonconducting state when the power source potential Vcc abruptly changes from 5 V to 3 V, for example, in a short period time as described above and a high potential of 3 V or so remains at the output terminal 16. Since, however, the current always flows in the current bypass circuit 30, the potential at the output terminal 16 is reduced through the ground potential Vss side. Accordingly, each of the PMOSs 12 and 14 is always maintained at a conducting state. As a result, the output terminal 16 is not brought into a floating state and is able to provide a stable output.

Incidentally, the present invention is not necessarily limited to the above embodiment. Even if, for example, the PMOS and the NMOS shown in FIG. 1 are replaced by the NMOS and the PMOS, respectively, and the first and second power sources shown in FIG. 1 are represented as Vss and Vcc respectively, operations and effects substantially similar to those obtained in the above embodiment can be obtained. Further, various changes such as the replacement of each of the resistors 11 and 42 by a load MOS, a change from the current-mirror type bias circuit 10, the current bypass circuit 30 and the bias circuit 40 to other circuits, etc. can be made.

Having now fully described the invention, it will be apparent to those skilled in the art that many changes and modifications can be made without departing from the spirit or scope of the invention as set forth herein.

What is claimed is:

1. A bias circuit for supplying a predetermined current to a next-stage circuit, comprising:

a first node having a first potential;

a second node having a second potential;

an output node electrically connected to said next-stage circuit;

a main bias circuit for supplying said predetermined current from said first node to said output node, the main bias circuit comprising:

a first resistive element having one end electrically connected to said first node, a first MOS transistor having a source electrode electrically connected to the other end of said first resistive element, a gate electrode electrically connected to said output node and a drain electrode, a second MOS transistor having drain and gate electrodes electrically connected to said drain electrode of said first MOS transistor, and a source electrode electrically connected to said second node, a third MOS transistor having a source electrode electrically connected to said first node, drain and gate electrodes electrically connected to said output node, and a fourth MOS transistor having a source electrode electrically connected to said second node, a drain electrode electrically connected to said output node, a gate electrode electrically connected to said drain electrode of said second MOS transistor;

an auxiliary bias circuit having a third node electrically connected to said gate electrode of said third transistor for activating said third transistor, the auxiliary bias circuit equalizing the value of current flowing from said first node to said third node with the value of a current flowing from said third node to said second node.

2. A bias circuit according to claim 1, wherein said auxiliary bias circuit comprises a fifth MOS transistor having a source electrode electrically connected to said first node, a drain electrode electrically connected to said output node, a sixth MOS transistor having a source electrode electrically connected to said second node, a drain electrode electrically connected to said output node, a seventh MOS transistor having a source electrode electrically connected to said first node, a second resistive element having one end electrically connected to a gate electrode of said fifth MOS transistor and to drain and gate electrodes of said seventh transistor, and an eighth MOS transistor having a source electrode electrically connected to said second node and drain and gate electrodes electrically connected to a gate electrode of said sixth MOS transistor and to the other end of said second resistive element.

3. A bias circuit for supplying a predetermined current to a next-stage circuit, comprising:

a first node having a first potential;

a second node having a second potential;

an output node electrically connected to said next-stage circuit;

a main bias circuit for supplying said predetermined current from said first node to said output node;

a third node electrically connected to said output node;

an auxiliary bias circuit for electrically equalizing the value of current flowing from said first node to said third node with the value of a current flowing from said third node to said second node, the auxiliary bias circuit comprising a first MOS transistor having a source electrode electrically connected to said first node and a drain electrode electrically connected to said third node, a second MOS transistor having a source electrode electrically connected to said second node and a drain electrode electrically connected to said third node, a third MOS transistor having a source electrode electrically connected to said first node, a first resistive element having one end electrically connected to a gate electrode of said first MOS transistor and to drain and gate electrodes of said third transistor, and a fourth MOS transistor having a source electrode electrically connected to said second node and drain and gate electrodes electrically connected to a gate electrode of said second MOS transistor and to the other end of said first resistive element.

4. A bias circuit for controlling activation of a next-stage circuit, comprising:

a first node having a first potential;

a second node having a second potential;

an output node electrically connected to said next-stage circuit;

a main bias circuit comprising a first current mirror circuit, the first current mirror circuit comprising a first MOS transistor having a first electrode electrically connected to said first node and second and gate electrodes electrically connected to said output node, and a second MOS transistor having a first electrode electrically connected to said first node, a second electrode electrically connectable to said second node and a gate electrode electrically connected to said output node, the second MOS transistor being activated in response to activation of the first MOS transistor, an auxiliary bias circuit comprising second and third current mirror circuits, the second current mirror circuit comprising a third MOS transistor having a first electrode electrically connected to said first node, and a fourth MOS transistor having a first electrode electrically connected to said first node with a second electrode electrically connected to said gate electrode of said first MOS transistor and a gate electrode electrically connected to second and gate electrodes of said third MOS transistor, and the third current mirror circuit comprising a fifth MOS transistor having a first electrode electrically connected to said second node and second and gate electrodes electrically connected to said second electrode of said third MOS transistor, and a sixth MOS transistor having a first electrode electrically connected to said second node with a second electrode electrically connected to said gate electrode of said first MOS transistor and a gate electrode electrically connected to said gate electrode of said fifth MOS transistor, the value of a current flowing in said second current mirror circuit equalizing with the value of a current flowing in said first current mirror circuit.

5. A bias circuit according to claim 4, wherein said main bias circuit further comprises a seventh MOS transistor having a first electrode electrically connected to said second node, a second electrode electrically connected to said output node and gate electrode electrically connected to said second electrode of said second MOS transistor, and an eighth MOS transistor having a first electrode electrically connected to said second node with second and gate electrodes electrically connected to said second electrode of said second MOS transistor.

6. A bias circuit according to claim 4, wherein said main bias circuit comprises a first resistive element electrically connected between said first node and said first electrode of said second MOS transistor.

7. A bias circuit according to claim 4, wherein said auxiliary bias circuit comprises a resistive element electrically connected between said second electrode of said third MOS transistor and said second electrode of said fifth MOS transistor.

* * * * *